US008707569B1

(12) United States Patent
Peterson

(10) Patent No.: US 8,707,569 B1
(45) Date of Patent: Apr. 29, 2014

(54) QUICK CHANGE CHAIN SAW SYSTEM

(71) Applicant: Jesse R. Peterson, Menominee, MI (US)

(72) Inventor: Jesse R. Peterson, Menominee, MI (US)

( * ) Notice: Subject to any disclaimer, the term of this patent is extended or adjusted under 35 U.S.C. 154(b) by 0 days.

(21) Appl. No.: 14/074,850

(22) Filed: Nov. 8, 2013

Related U.S. Application Data

(62) Division of application No. 12/703,912, filed on Feb. 11, 2010.

(51) Int. Cl.
*B27B 17/00* (2006.01)
*B27B 11/02* (2006.01)

(52) U.S. Cl.
USPC ..... 30/386; 83/818

(58) Field of Classification Search
CPC ..... B27B 17/14; B27G 17/003
USPC ..... 30/380–387; 83/818
See application file for complete search history.

(56) References Cited

U.S. PATENT DOCUMENTS 4,315,370 A * 2/1982 Horne ..... 30/386
4,356,750 A * 11/1982 Legler et al. ..... 83/816
5,987,786 A * 11/1999 Gibson et al. ..... 37/302
6,032,373 A 3/2000 Peterson
6,345,447 B1 * 2/2002 Ronkko ..... 30/386
6,539,832 B1 4/2003 Nilsson
7,287,330 B1 10/2007 Riha
2003/0005805 A1 * 1/2003 Lee ..... 83/699.51

* cited by examiner

*Primary Examiner* — Kenneth E. Peterson
*Assistant Examiner* — Samuel A Davies
(74) *Attorney, Agent, or Firm* — Donald J. Ersler

(57) ABSTRACT

A quick change chain saw system includes a swing arm and a hydraulic clamp device. The swing arm extends from the hydraulic clamp device. The swing arm retains drive sprocket components and is retained by a tree harvester or wood processor unit. The hydraulic clamp device includes a hydraulic clamp block, a puck plate, a clamp plate and a detent pin. The puck plate includes a base plate and three stud projections that is actuated with a plurality of pucks in the hydraulic clamp block. Three stud projections extend from the base plate and are inserted through the hydraulic clamp block. The clamp plate is secured to the three stud projections. A spring tensioner is used to bias the chain bar. A retraction tool is used to retract the hydraulic clamp device. The detent pin is used keep the hydraulic clamp in a retracted position for changing the chain blade.

14 Claims, 8 Drawing Sheets

QUICK CHANGE CHAIN SAW SYSTEM

CROSS-REFERENCES TO RELATED APPLICATIONS

This is a divisional application of nonprovisional application Ser. No. 12/703,912 filed on Feb. 11, 2010.

BACKGROUND OF THE INVENTION

1. Field of the Invention

The present invention relates generally to chain saws and more specifically to a quick change chain saw system, which allows a chain blade to be replaced in a short period of time.

2. Discussion of the Prior Art

U.S. Pat. No. 5,987,786 to Gibson et al. discloses a guide bar mount for a tree harvester. The Gibson et al. patent includes a a tail end of a guide bar provided with a center slot and pin receiving slot at each side thereof. The guide bar is retained by a sliding block. U.S. Pat. No. 6,032,373 to Peterson discloses methods and apparatus for adjusting chain saw tension. The Peterson patent includes a first piston operable to move the support bar radially away from the drive sprocket and a second piston operable to limit such movement. U.S. Pat. No. 6,539,832 to Nilsson discloses a hydraulic stretching device for a chain saw. The Nilsson patent includes a hydraulic stretching device for a saw chain active in a sawing apparatus. U.S. Pat. No. 7,287,330 to Riha discloses a chain saw automatic tensioner. The Riha patent includes a base plate, a chain bar, a tensioning cylinder, a sliding block and a pusher block. The tensioning cylinder is used to tension the chair bar relative to the base plate.

Accordingly, there is a clearly felt need in the art for a quick change chain saw system, which allows a chain blade to replaced in a short period of time and keeps a chain bar rigidly clamped.

SUMMARY OF THE INVENTION

The present invention provides a quick change chain saw system, which allows a chain blade to replaced in a short period of time. The quick change chain saw system includes a swing arm and a hydraulic clamp device. The swing arm extends from the hydraulic clamp device. The swing arm retains drive sprocket components and is retained by a tree harvester unit or wood processor unit. The hydraulic clamp device includes a hydraulic clamp block, a puck plate, a clamp plate and a plurality of clamp pucks. The hydraulic clamp block includes a plurality of puck cylinders for retaining the plurality of clamp pucks. The puck plate includes a base plate and three stud projections. The stud projections extend from the base plate. Three openings are formed through the hydraulic clamp block to provide clearance for the three stud projections. The clamp plate is secured to the three stud projections with three threaded nuts. A spring tensioner is retained in the hydraulic clamp block to bias the puck plate away from a bearing bore in the swing arm.

In use, a chain bar is inserted between the clamp plate and a bottom of the hydraulic clamp block. To install a chain blade on the chain bar, a retraction tool is used to pull the clamp plate toward the bearing bore (retracted position) to place the chain blade around a drive sprocket and the chain bar. A detent pin is disposed in a side of the hydraulic clamp block for retaining the puck plate in a retracted position. The retraction tool momentarily pulled back to release the detent pin and the retraction tool is slowly released to secure the chain blade around the drive sprocket and the chain bar. The process is reversed to remove the chain blade from the drive sprocket and the chair bar.

Accordingly, it is an object of the present invention to provide a quick change chain saw system, which allows a chain blade to replaced in a short period of time.

Finally, it is another object of the present invention to provide a quick change chain saw system, which keeps a chain bar rigidly clamped and reliably tensioned.

These and additional objects, advantages, features and benefits of the present invention will become apparent from the following specification.

DETAILED DESCRIPTION OF THE PREFERRED EMBODIMENTS

Figure 1:
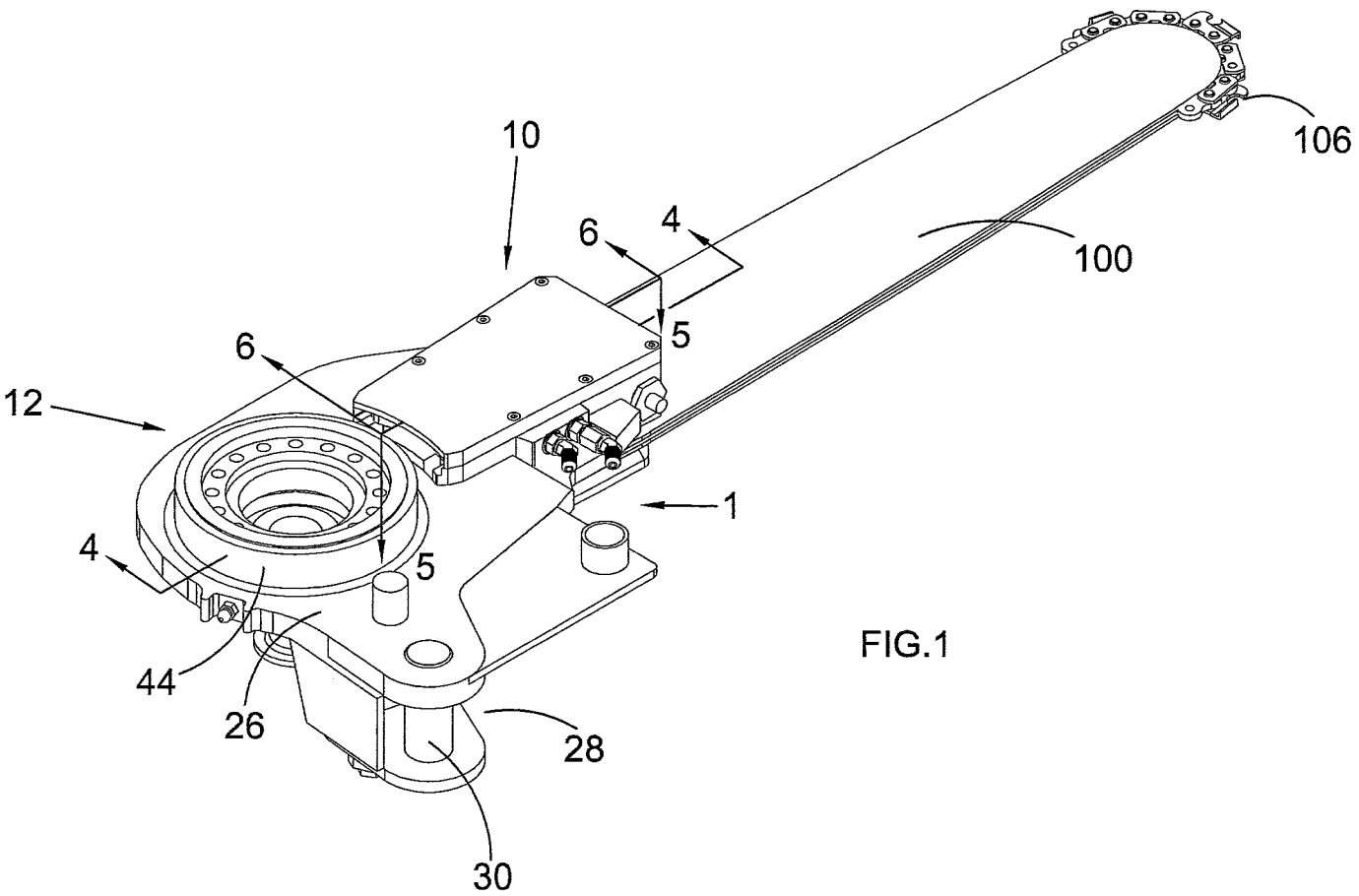
FIG. 1 is a perspective view of a quick change chain saw system, a chain bar and sprocket components in accordance with the present invention.
Figure 2:
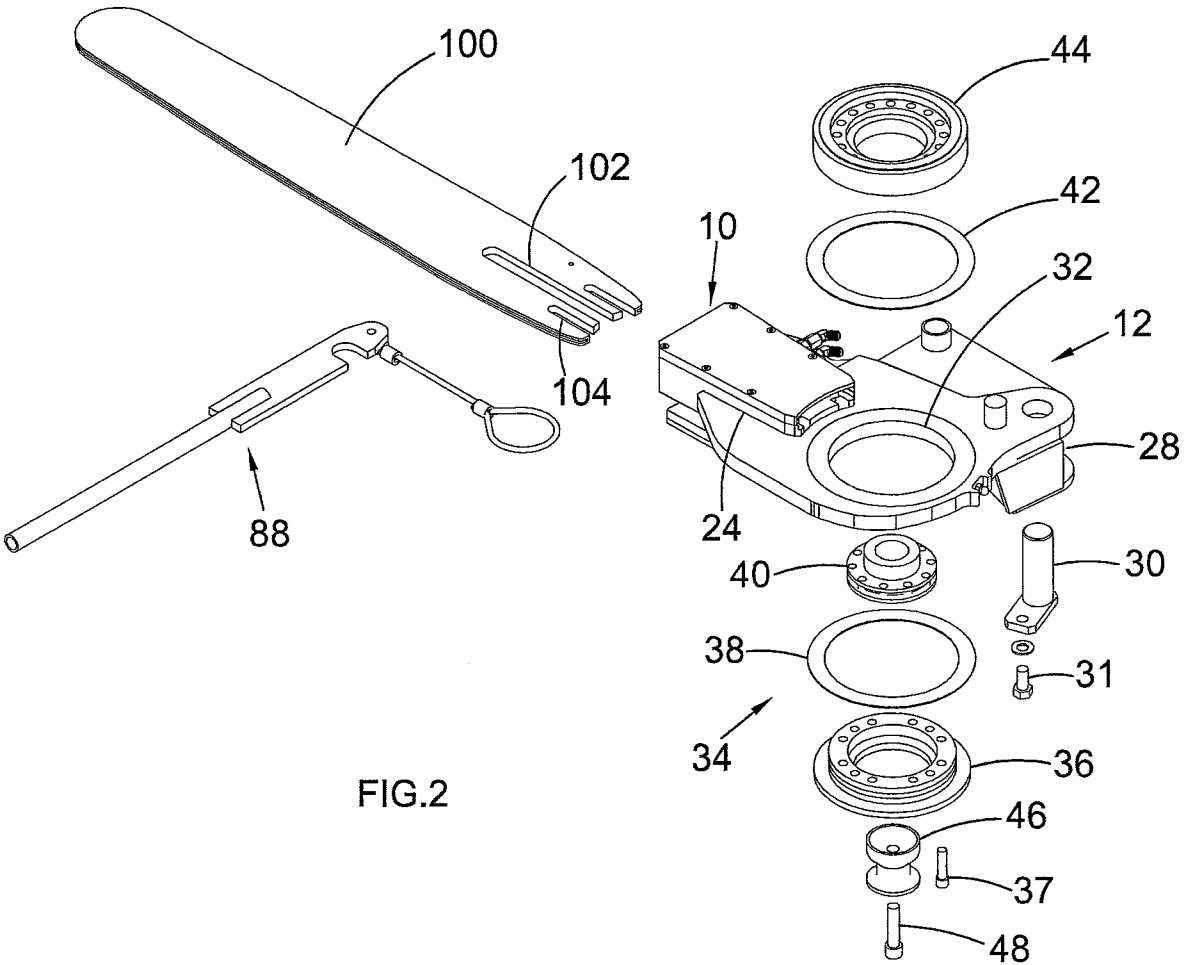
FIG. 2 is a partially exploded perspective view of a quick change chain saw system with a retraction tool, a chain bar, sprocket components and cylinder rod pin in accordance with the present invention.
Figure 3:
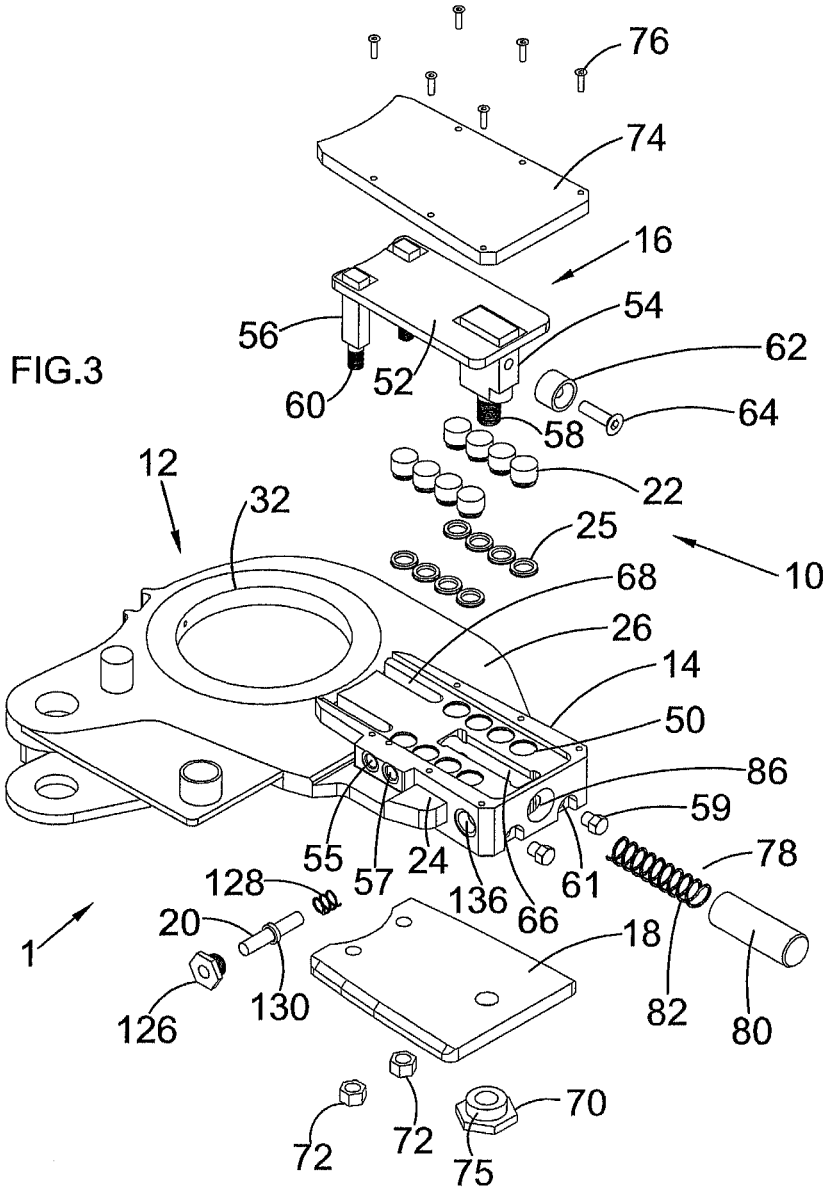
FIG. 3 is an exploded perspective view of a quick change chain saw system in accordance with the present invention.

With reference now to the drawings, and particularly to FIG. 1, there is shown a top view of a quick change chain saw system 1 with other components retained therein. With reference to FIGS. 2-3, the quick change chain saw system 1 includes a hydraulic clamp device 10 and a swing arm 12. The swing arm 12 extends from the hydraulic clamp device 10. The hydraulic clamp device 10 includes a hydraulic clamp block 14, a puck plate 16, a clamp plate 18, a detent pin 20 and a plurality of clamp pucks 22.

The swing arm 12 includes a base plate 26, a cylinder yoke 28 and a cylinder pin 30. The cylinder pin 30 is secured to the cylinder yoke 28 with a fastener 31. The hydraulic clamp block 14 is preferably welded into a block slot 24 formed in the base plate 26. A bearing bore 32 is formed through the base plate 26. The swing arm 12 has a different design depending upon the brand and model of tree harvester unit or wood processing unit. Drive sprocket components 34 are retained in the bearing bore 32. The drive sprocket components 34 include a lower retaining flange 36, a lower thrust washer 38, a sprocket assembly 40, an upper thrust washer 42 and an upper retaining flange 44. A chain catcher 46 is secured to a shaft of a sprocket drive motor (not shown) with a fastener 48. The retaining flange 36 is secured to upper retaining flange 44 with at least one fastener 37.

Figure 5:
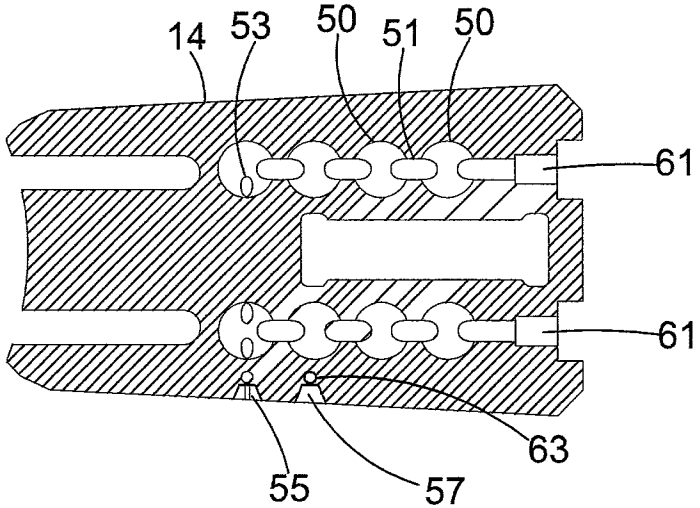
FIG. 5 is a cross sectional view of a plurality of puck cylinders in a hydraulic clamp block of a quick change chain saw system in accordance with the present invention.
Figure 4:
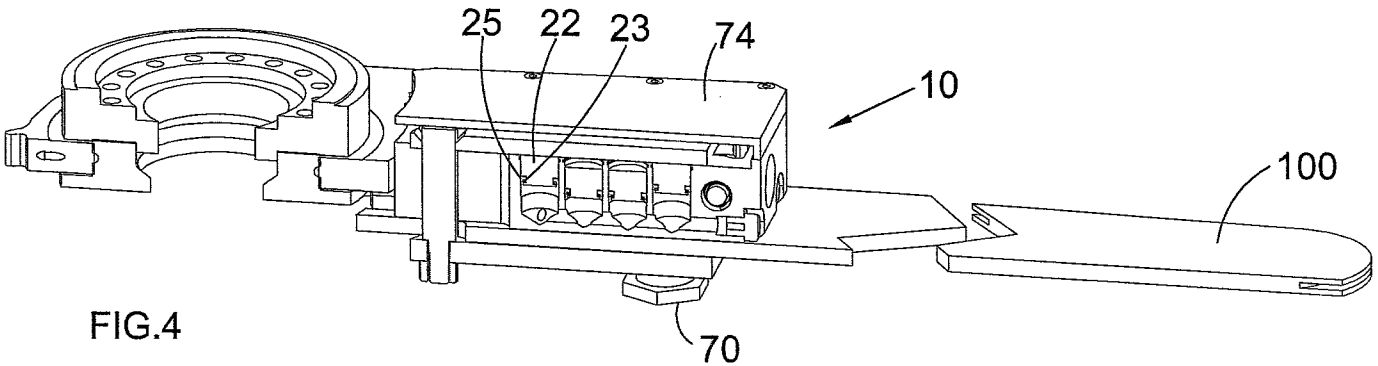
FIG. 4 is a cross sectional view of a quick change chain saw system, a chain bar and sprocket components in accordance with the present invention.

With reference to FIGS. 4-5, the hydraulic clamp block 14 includes a plurality of puck cylinders 50 for retaining the plurality of pucks 22. A hydraulic oil passage 51 is formed through first and second rows of puck cylinders 50 by drilling two holes through an end of the hydraulic clamp block 14. The two hydraulic oil passages 51 are sealed by threading two pipe tap nuts 59 into two threaded orifices 61 of the two hydraulic oil passages 51. However, other methods of plugging the ends of the two oil passages 51 may also be used. A hydraulic oil cross passage 53 is formed through the hydraulic clamp block 14 and the first one of the first and second row of puck cylinders 50 with a drill. The hydraulic oil cross passage 53 communicates with a threaded orifice 55. At least one lubricating oil passage 63 is formed through the hydraulic clamp block 14 for oiling the chain bar 100. The at least one lubricating oil passage 63 is communicates with a threaded orifice 57. A puck seal 25 is snapped into a groove 23 in each clamp puck 22. The puck seal 25 provides a hydraulic seal with each cylinder 50.

Figure 6:
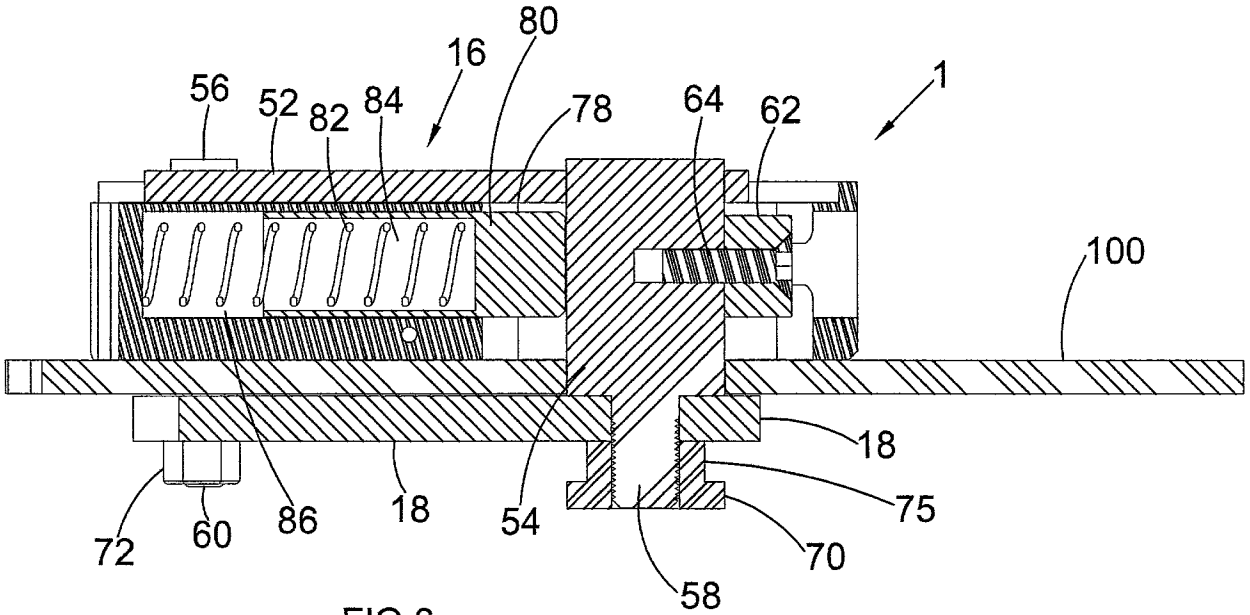
FIG. 6 is a cross sectional view of a compression spring in a hydraulic clamp block of a quick change chain saw system in accordance with the present invention.

With reference to FIG. 6, the puck plate 16 includes a base plate 52, a front stud projection 54 and two rear stud projections 56. A front threaded stud 58 extends from the from front stud projection 54 and a rear threaded stud 60 extends from each rear stud projection 56. The stud projections 54, 56 are preferably welded to the base plate 52. A detent stop 62 is attached to the front stud projection 54 with a fastener 64. A front projection slot 66 is formed through the hydraulic clamp block 14 to provide clearance for the front stud projection 54 and two rear projection slots 68 are formed through the hydraulic clamp block 14 to provide clearance for the two rear stud projections 56.

The clamp plate 18 is secured to the puck plate 16 by securing a front nut 70 on to the front threaded stud 58 and two rear nuts 72 on to the two rear threaded studs 60. However, other types of removable fasteners may be used to secure the clamp plate 18, besides threaded nuts. The front nut 70 includes a cylindrical portion 75. A cover plate 74 is attached to a top of the hydraulic clamp block 14 with a plurality of fasteners 76. A spring tensioner 78 includes a spring housing 80 and a compression spring 82. A spring bore 84 is formed in the spring housing 80 to receive the compression spring 82. A tensioner bore 86 is formed substantially through a length of the hydraulic clamp block 14 to slidably receive the spring housing 80.

A chain bar 100 retains and supports most of a chain blade 106. The chain bar 100 is typically purchased from any one of numerous suppliers. The chain bar 100 includes a first end having a center slot 102 and two side slots 104. The front slot 102 is sized to receive the front stud projection 54 and the two rear slots 104 are sized to receive the two rear stud projections 56. The first end of the chain bar 100 is inserted between a bottom of the hydraulic clamp block 14 and the clamp plate 18. The spring tensioner 78 biases the puck plate 16 away from the bearing bore 32, which results in the chain bar 100 putting tension on the chain blade 106.

Figure 7:
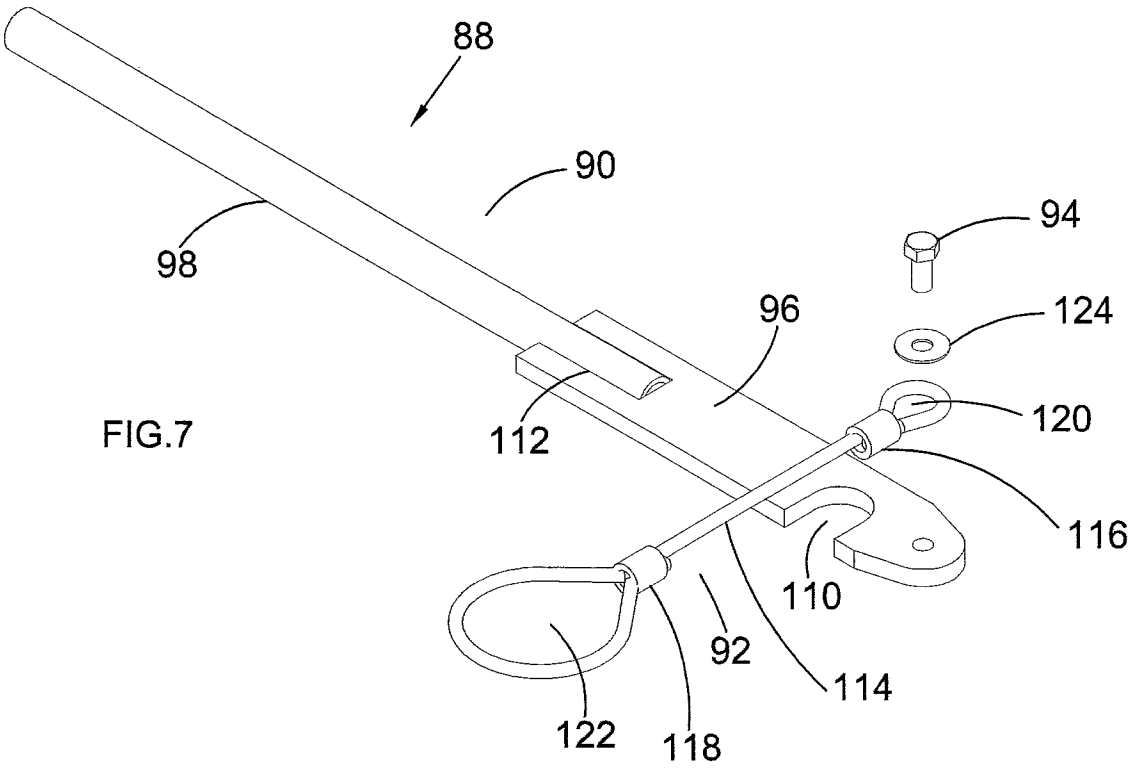
FIG. 7 is an exploded perspective view of a retraction tool of a hydraulic clamp block of a quick change chain saw system in accordance with the present invention.

With reference to FIG. 7, a retraction tool 88 preferably includes a handle 90, a pull member 92 and a fastener 94. The handle 90 preferably includes a pivot plate 96 and a pole 98. The pivot plate 96 includes a pivot slot 110 and a pole slot 112. The pole slot 112 is formed in one end of the pivot plate 96 to receive the pole 98. The pole 98 is preferably welded to the pivot plate 96. The pull member 92 includes a cable 114, a first cable tie 116 and a second cable tie 118. The cable 114 is doubled over on a first end and secured with the first cable tie 116 to form a pivot loop 120. The cable 114 is doubled over on a second end and secured with the second cable tie 118 to form a catcher loop 122. The fastener 94 is inserted through a washer 124 and the pivot loop 120, before being threaded into the other end of the pivot plate 96. The catcher loop 122 is sized to receive an outer perimeter of the chain catcher 46. However, other designs or types of suitable retraction tools may also be used.

Figure 8:
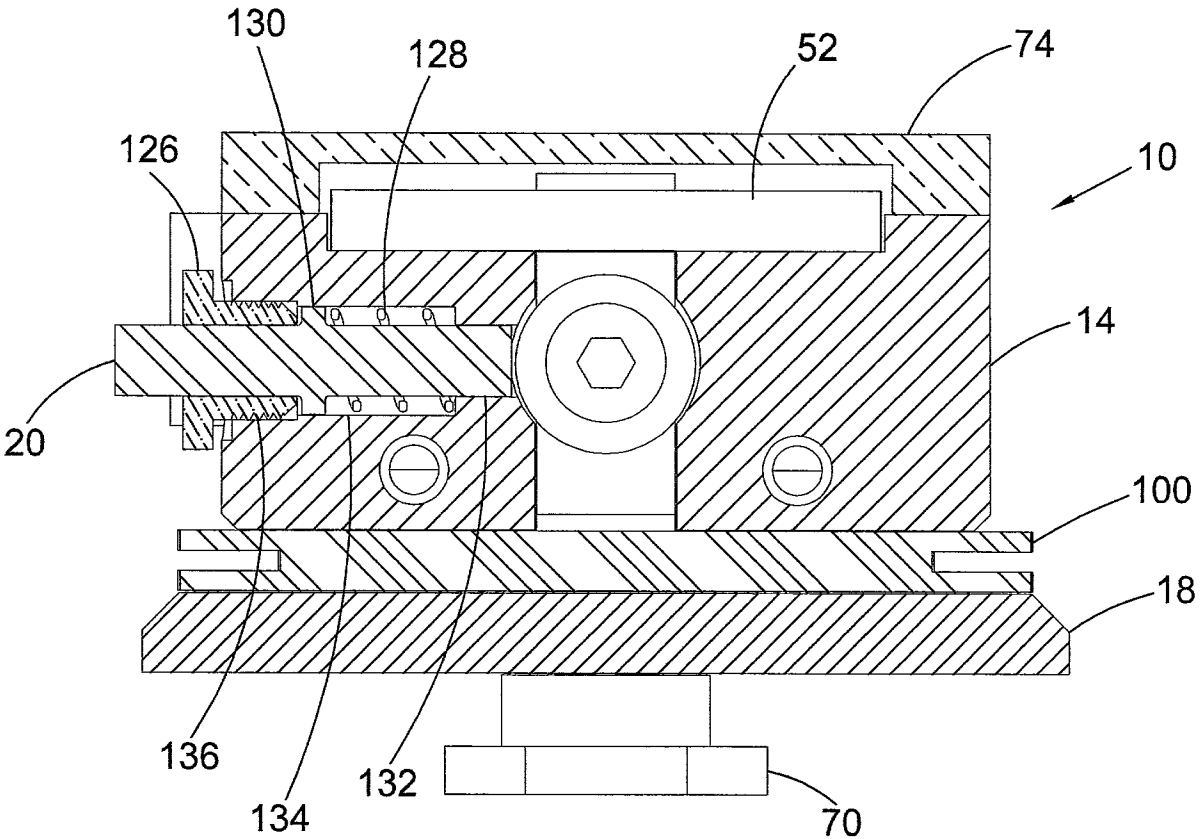
FIG. 8 is a cross sectional view of a detent pin retained in the hydraulic clamp block of a quick change chain saw system in accordance with the present invention.

With reference to FIG. 8, the detent pin 20 is retained in the hydraulic clamp block 14 with a retention nut 126. The detent pin 20 is biased to extend out-of the hydraulic clamp block 14 with a compression spring 128. A spring shoulder 130 is formed on an outer perimeter of the detent pin 20 to provide a bearing surface for the compression spring 128. A pin bore 132 is formed through the hydraulic clamp block 14 to slidably receive one end of the detent pin 20. A spring counterbore 134 is formed in the hydraulic clamp block 14 to receive the compression spring 128. The spring counter bore 134 is terminated with a threaded tap 136 to threadably receive the retention nut 126.

Figure 9:
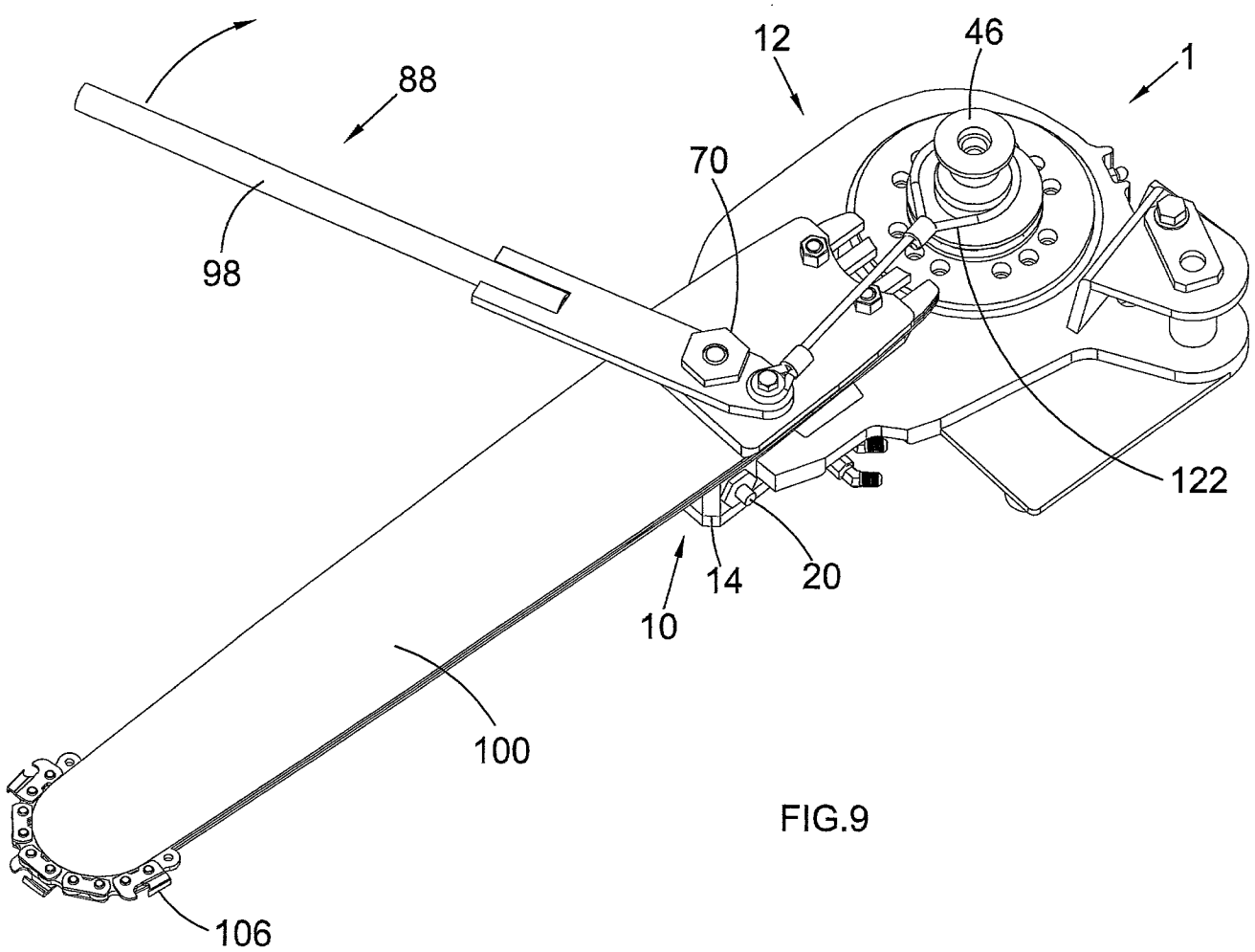
FIG. 9 is a perspective view of a retraction tool engaged with a quick change chain saw system in accordance with the present invention.

With reference to FIG. 9, the first end of the chain bar 100 is inserted between the clamp plate 18 and a bottom of the hydraulic clamp block 14. To install a chain blade 106 on the chain bar 100, the catcher loop 122 of the pull member 114 is placed over the chain catcher 46 and the pivot slot 110 of the retraction tool 88 is slipped over the cylindrical portion 75 of the front nut 70. An end of the handle 98 is pulled toward the chain catcher 46, the front stud projection 54 moves toward the chain catcher 46 and the detent pin 20 is pushed in front of the front stud projection 54. The handle 98 is released, before the detent pin 20 is released.

The detent pin 20 holds the hydraulic clamping device 10 in a retracted position by contacting the detent stop 62. The chain blade 106 is installed, while the hydraulic clamping device 10 is in a retracted position. The handle 98 is pulled toward the chain catcher 46, the detent pin 20 pops out due to the biasing of the compression spring 128. The handle 98 is slowly released to make sure the chain blade is seated on the chain bar 100. The chain bar 100 is retained in the hydraulic clamping device 10 and clamped by pressurizing the plurality of clamp pucks 22 with hydraulic fluid entering the hydraulic oil inlet port 55.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A quick change chain saw system, comprising:

a hydraulic clamping device including a hydraulic clamp block, a puck plate and a clamp plate;

at least two projections extend from said puck plate, said at least two projections are inserted through at least two openings in said hydraulic clamp block, said clamp plate is secured to said at least two projections;

a plurality of clamp pucks are retained in said hydraulic clamp block to exert force on said puck plate with hydraulic oil;

a swing arm extends from said hydraulic clamp device, said swing arm includes a bearing bore;

means for biasing said puck plate away from said bearing bore; and a retraction device for retraction of said puck plate toward said bearing bore, said retraction device includes a handle and a pull member, one end of said pull member is pivotally retained on said handle, a pivoting loop is formed on the other end of said pull member, said pivoting loop is sized to receive a chain catcher, said handle is pivotally engaged with said hydraulic clamp device.

2. The quick change chain saw system of claim 1, further comprising:

a detent pin is slidably retained in said hydraulic clamp block, said detent pin removably retains said hydraulic block device in a retracted position.

3. The quick change chain saw system of claim 2, further comprising:

said detent pin is biased to extend out-of said hydraulic clamp block.

4. The quick change chain saw system of claim 1, further comprising:

said means for biasing said puck plate is a spring retained in said hydraulic clamp block.

5. The quick change chain saw system of claim 1, further comprising:

a plurality of puck cylinders are formed in said hydraulic cylinder block to receive said plurality of clamp pucks.

6. A quick change chain saw system, comprising:

a hydraulic clamping device including a hydraulic clamp block, a puck plate and a clamp plate;

at least two projections extend from said puck plate, said at least two projections are inserted through at least two openings in said hydraulic clamp block, said clamp plate is secured to said at least two projections;

a plurality of clamp pucks are retained in said hydraulic clamp block to exert force on said puck plate with hydraulic oil;

a swing arm extends from said hydraulic clamp device, said swing arm includes a bearing bore;

a spring for biasing said puck plate away from said bearing bore; and a retraction device for retraction of said puck plate toward said bearing bore, said retraction device includes a handle and a pull member, one end of said pull member is pivotally retained on said handle, a pivoting loop is formed on the other end of said pull member, said pivoting loop is sized to receive a chain catcher, said handle is pivotally engaged with said hydraulic clamp device.

7. The quick change chain saw system of claim 6, further comprising:

a detent pin is slidably retained in said hydraulic clamp block, said detent pin removably retains said hydraulic block device in a retracted position.

8. The quick change chain saw system of claim 7, further comprising:

said detent pin is biased to extend out-of said hydraulic clamp block.

9. The quick change chain saw system of claim 6, further comprising:

a plurality of puck cylinders are formed in said hydraulic cylinder block to receive said plurality of pucks.

10. A quick change chain saw system, comprising:

a hydraulic clamping device including a hydraulic clamp block, a puck plate, a clamp plate and a plurality of clamp pucks;

at least two projections extend from said puck plate, said at least two projections are inserted through at least two openings in said hydraulic clamp block, said clamp plate is secured to said at least two projections;

a plurality of pucks are retained in said hydraulic clamp block to exert force on said puck plate with hydraulic oil;

a swing arm extends from said hydraulic clamp device, said swing arm includes a base plate, a cylinder yoke and a cylinder pin, said cylinder pin is retained in said cylinder yoke, said hydraulic clamp block is attached in a block slot formed in said base plate, a bearing bore is formed through said base plate;

means for biasing said puck plate away from said bearing bore; and a retraction device for retraction of said puck plate toward said bearing bore, wherein said retraction device includes a handle and a pull member, one end of said pull member is pivotally retained on said handle, a pivoting loop is formed on the other end of said pull member, said pivoting loop is sized to receive a chain catcher, said handle is pivotally engaged with said hydraulic clamp device.

11. The quick change chain saw system of claim 10, further comprising:

a detent pin is slidably retained in said hydraulic clamp block, said detent pin removably retains said hydraulic block device in a retracted position.

12. The quick change chain saw system of claim 11, further comprising:

said detent pin is biased to extend out-of said hydraulic clamp block.

13. The quick change chain saw system of claim 10, further comprising:

said means for biasing said puck plate is a spring retained in said hydraulic clamp block.

14. The quick change chain saw system of claim 10, further comprising:

a plurality of puck cylinders are formed in said hydraulic cylinder block to receive said plurality of clamp pucks.

* * * * *